US008839467B2

(12) United States Patent
Sclafani

(10) Patent No.: US 8,839,467 B2
(45) Date of Patent: Sep. 23, 2014

(54) STANDALONE HAIR WASHING SINK

(76) Inventor: Janene Sclafani, Fort Lauderdale, FL (US)

( * ) Notice: Subject to any disclaimer, the term of this patent is extended or adjusted under 35 U.S.C. 154(b) by 230 days.

(21) Appl. No.: 13/403,737

(22) Filed: Feb. 23, 2012

(65) Prior Publication Data

US 2013/0219608 A1 Aug. 29, 2013

(51) Int. Cl.

| | |
|---|---|
| ***A47K 3/14*** | (2006.01) |
| ***E03C 1/186*** | (2006.01) |
| ***A45D 19/00*** | (2006.01) |
| ***A45D 19/02*** | (2006.01) |
| ***A45D 19/08*** | (2006.01) |
| ***A45D 19/10*** | (2006.01) |

(52) U.S. Cl.
USPC ..... 4/514; 4/519; 4/518; 4/515

(58) Field of Classification Search
USPC ..... 4/514–523, 643; D23/270–313
See application file for complete search history.

(56) References Cited

U.S. PATENT DOCUMENTS

| | | | | |
|---|---|---|---|---|
| 668,322 | A * | 2/1901 | Stephen | 4/514 |
| 1,223,263 | A | 4/1917 | Day | |
| 1,791,348 | A | 2/1931 | Cannady | |
| 2,167,572 | A | 7/1939 | Howe | |
| 2,357,461 | A | 9/1944 | Ellinger | |
| D155,841 | S | 11/1949 | Roberts | |
| 2,548,301 | A * | 4/1951 | Gibson | 4/553 |
| D173,813 | S | 1/1955 | Militana | |
| 3,816,858 | A | 6/1974 | Martin | |
| 4,014,054 | A * | 3/1977 | Pasquarello | 4/521 |
| D267,669 | S | 1/1983 | Pounds | |
| 4,611,354 | A | 9/1986 | Jones | |
| D346,242 | S | 4/1994 | McNally | |
| 5,692,251 | A | 12/1997 | Page | |
| 5,896,595 | A | 4/1999 | Spencer | |
| D425,245 | S | 5/2000 | Davis | |
| 6,367,101 | B2 | 4/2002 | Shimizu | |
| D459,448 | S | 6/2002 | Minami | |
| 6,526,605 | B2 | 3/2003 | Shimizu | |
| 6,553,943 | B1 | 4/2003 | Murphy | |
| D530,407 | S * | 10/2006 | McDowell | D23/289 |
| D621,093 | S | 8/2010 | Jenkins | |
| D630,796 | S | 1/2011 | Bass | |
| D639,506 | S | 6/2011 | Landsberger et al. | |
| D654,992 | S * | 2/2012 | Bucher | D23/286 |

(Continued)

OTHER PUBLICATIONS

The Gardenweb.com forum dated Feb. 2009.*

*Primary Examiner* — Huyen Le
*Assistant Examiner* — Christine Skubinna
(74) *Attorney, Agent, or Firm* — The Concept Law Group, P.A.; Scott D. Smiley; Yongae Jun

(57) ABSTRACT

A standalone hair washing sink includes a body coupled to a ground surface of a building and extending upwardly from the ground surface. The body defines a water channel extending between an upper portion of the body and a lower portion of the body at the ground surface and the water channel is in fluid communication with a drain at the ground surface and is sized to accommodate and provide access to long hair during a hair-washing process. An opening extends upwardly from the lower portion of the body toward the upper portion of the body and exposes a lower portion of the water channel. A receiving area at the upper portion of the body is shaped to comfortably receive and support a head or neck of a user.

9 Claims, 7 Drawing Sheets

100

(56) References Cited

U.S. PATENT DOCUMENTS

D681,177 S * 4/2013 Young et al. ..... D23/289
2001/0032356 A1* 10/2001 Shimizu ..... 4/515
2002/0007511 A1* 1/2002 Shimizu et al. ..... 4/515
2006/0053545 A1* 3/2006 Schulken ..... 4/515
2008/0229492 A1* 9/2008 Jamieson ..... 4/578.1

* cited by examiner

100

100

100

600

700

STANDALONE HAIR WASHING SINK

FIELD OF THE INVENTION

The present invention relates generally to hair washing sinks, and more particularly relates to a sink shaped to accommodate people with long hair.

BACKGROUND OF THE INVENTION

Each year, billions of dollars are spent on cosmetically-related products and services. Many of these products, for example, razors, tweezers, shampoos, conditioners, etc., are applied and used by the purchaser in the privacy of their home. However, one aspect of personal grooming—head-hair growth—cannot be easily and properly dealt with without help.

To maintain a well-groomed appearance, people usually present themselves to salons and other hair-cutting businesses. In order for the hair-cutting professional to work with the hair in the best condition, the person's hair should be washed and free of dirt, oils, and products. For that reason, all hair salons have sinks for cleaning the client's hair prior to cutting or other treatments, e.g., dyeing. Most known sinks generally used for washing hair in these salons are attached to and extend from a wall. To wash a person's hair, the person is placed in a chair with an angled back, which allows the person to place the back of his or her head/neck area on a front/lip portion of the sink. Unfortunately, due to the shallow bowl of standard sinks, those with longer hair find that their hair simply lies at the bottom of sink bowl and collects around and covers the drain area.

The shape/dimensions of these presently known sinks make it impossible or very difficult to extend and properly clean longer hair. Most known sinks provide no option for the operator, usually an employee at a hair salon, for example, other than leaving the person's hair at the bottom of the sinks causing the hair to be bunched together in order to be washed. As the hair is often in contact with the draining area at the lower portion of the sink during and after the cleaning process, the recently cleaned hair may become compromised by any debris or dirt that was previously removed and has accumulated. Further, when the hair accumulates at the draining area of the sink it often causes a build-up of water.

Some prior-art sinks have attempted to incorporate deeper openings to accommodate longer hair. As these known sinks are fixedly connected to and supported by wall, many operators find it difficult, if not impossible, to reach down and wash the person's hair effectively and efficiently. Some known systems that allow a person's hair to extend include using a funnel-type apparatus that extends from the head/neck area of the person down to the standard-sized sink opening. These apparatuses generally extend from a distance away from the standard-sized sink to accomplish the hair extension. These systems used for washing a person with longer hair, however, disadvantageously take up a significant amount of space, as the person must be a distance away from the sink. Those apparatuses used in connection with sinks also are generally cumbersome and require storage when not washing a person with longer hair. Moreover, these apparatuses generally require use in combination with a separate and distinct sink. In addition, many of these known hair washing apparatuses further require the person's hair to be pulled through an aperture in the funnel-type apparatus thereby securing the apparatus to the top of the user's head, instead of the standard head/neck area resting on a portion of the sink. Those aforementioned systems are undesirable and uncomfortable for the person having their hair washed as he or she is supporting the weight of the funnel-type apparatus. Further, these systems are also undesirable as the aperture that fits on the person's head is susceptible to leaking when confronted with water around the edges of the aperture.

Some known sinks try to circumvent these issues by integrating an automated hair washing system for washing a person's hair. These known systems incorporate knobs, pulleys, and other devices for holding and directing the person's hair. These systems, however, are generally not effective or applicable for persons with long hair and often cost a significant amount of money to purchase and/or to maintain. Moreover, these automated systems require more time to set up the person having his or her hair washed, which is cost and time intensive. These systems also often cause discomfort to the person being washed as those aforementioned devices for holding and directing the person's hair also tug and pull on it.

Furthermore, with most known sinks being attached to a wall of a building, the operator can generally only access the hair from two sides of the sink body in order to clean and wash the hair. For those known sinks that have a deeper opening than most standard-sized sinks, it is difficult, if not impossible, for the operator to thoroughly access and clean a person with long hair without bending or twisting the operator's body in uncomfortable positions. This is often undesirable for many operators.

It is also generally known when washing a person's hair that hair follicles sometimes become dislodged from their roots, subsequently becoming tangled or lodged in the drain area of a sink. For businesses that intake a medium to high volume of clients, a hair washing sink that provides a client with quick, efficient, and quality cleaning is desired. It is further desired to have a hair washing sink that is relatively easy to maintain and provides quick clean-up resulting from any debris generated from the hair washing process. As most of those known sinks have the drain located above the floor of a building structure, the operator is often required to physically remove any debris or in some cases, dislodge hair follicles from the drain. This is often done by using the operator's hands, or a towel or cloth, which is not desired and in some cases, not sanitary. Those known sinks for washing hair generally do not provide an effective and efficient way to clean the area where any debris or residue might build up by the drain, or an associated drain screen. As discussed, those known sinks for washing hair are generally attached to the side wall of a building and the draining area is above the ground surface of the building. As such, an operator generally cannot effectively use traditional cleaning tools, such as a mop or broom, to remove any dislodged hair or other debris generated from the cleaning process.

In addition, many of those known systems for washing hair often require the user, or the chair in which the user is sitting, to be adjusted to the appropriate height of the sink. Most known sinks do not have the ability to adjust themselves to the user without incorporating a separate device independent of the sink structure. This is often desirable for situations where the functional limitations of bending the chair, or user, have been reached. Again, as those known sinks generally extend from the side wall of the building from which they are attached, the operator is limited to placing the sinks along the side wall. This limits the sink placement locations for the operator in situations where the operator desires to have the side walls occupied by other objects, such as furniture and salon equipment, for example, or to have the side walls unobstructed entirely.

Therefore, a need exists to overcome the problems with the prior art as discussed above.

SUMMARY OF THE INVENTION

The invention provides a standalone hair washing sink that overcomes the hereinaforementioned disadvantages of the heretofore-known devices and methods of this general type and that facilitates the hair washing process, particularly for those persons with tong hair, and the clean-up process thereafter.

With the foregoing and other objects in view, there is provided, in accordance with the invention, a hair washing sink that is suited for long hair with the sink have a body that is coupled a ground surface of a building and extending upwardly from the ground surface to define a water channel extending between an upper portion of the body and a lower portion of the body at the ground surface and sized to accommodate and provide access to long hair during a hair washing process and defining an opening that extends upwardly from the lower portion toward the upper portion and exposes a tower portion of the water channel. The sink also has a receiving area at the upper portion of the body shaped to receive and support a head/neck area of a user.

In accordance with another feature of the present invention, the body is supported by the ground surface only and does not rely on a wall for physical support.

In accordance with a further feature, an embodiment of the present invention includes an elongated discontinuous gap in the body.

In accordance with a yet another feature, an embodiment of the present invention also includes the discontinuous gap in the body extending from the ground surface to the upper portion of the body.

In accordance with a further feature, an embodiment of the present invention includes the elongated gap in the body sized to allow a bristle portion of a standard-sized broom to pass through.

In accordance with an additional feature of the present inventions, the body has a front interior surface below the receiving area that has at least portion at a non-perpendicular angle to the ground surface.

In accordance with one more feature, an additional embodiment of the present invention includes a base at the lower portion of the body that provides physical support to the sink and having a drain screen accessible through the opening.

In with yet another feature of the present invention, the body is formed at least partially around a drain.

In accordance with another feature, an embodiment of the present invention includes a sink body positioned over a floor drain with the body defining a base coupled to the floor surface and at least partially surrounding the floor drain, an upper edge that has a head receiving area opposite the base and shaped to receiving a head/neck of a user, and a discontinuous gap that extends from the base toward the upper edge.

In accordance yet another feature, an embodiment of the present invention also includes the discontinuous gap defining a continuous opening between the base and the upper edge.

In accordance one more feature, an embodiment of the present invention includes the base providing the only physically support for the sink.

In accordance with yet another feature of the present invention, one embodiment includes the base having a drain screen.

In accordance with yet another feature, an embodiment of the present invention includes a body coupled to a ground surface of a building and having a discontinuous side wall, the discontinuous side wall extending upwardly from the ground surface toward an upper edge of the body, defining a water channel with a lower portion substantially at the floor surface and sized to accommodate and provide access to long hair during a hair washing process, and defining a discontinuous gap extending upwardly from the ground surface toward the upper, sufficiently sized to allow a cleaning portion of a standard-sized broom to enter the lower portion of the water channel. The body also has a drain in fluid communication with the water channel and a head/neck support shaped to substantially contour a head/neck area of a user.

In accordance with yet another feature, an embodiment of the present invention includes the base extending outwardly in a direction away from the lower portion of the water channel and coupled to the discontinuous side wall.

In accordance with yet another feature, an embodiment of the present invention includes a portion of the base that is adjacent to the discontinuous gap and substantially co-planar with the lower portion of the water channel.

In accordance with another feature, an embodiment of the present invention also includes the head/neck area support in the shape of a half circle.

In accordance with one more feature, an embodiment of the present invention also includes a water faucet assembly coupled to the body.

In accordance yet another feature, an embodiment of the present invention further includes the body extending upwardly from the ground surface a height greater than 1.5 feet.

Although the invention is illustrated and described herein as embodied as a standalone hair-washing sink, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the sink extending from the floor of a building structure to the receiving area of the sink.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
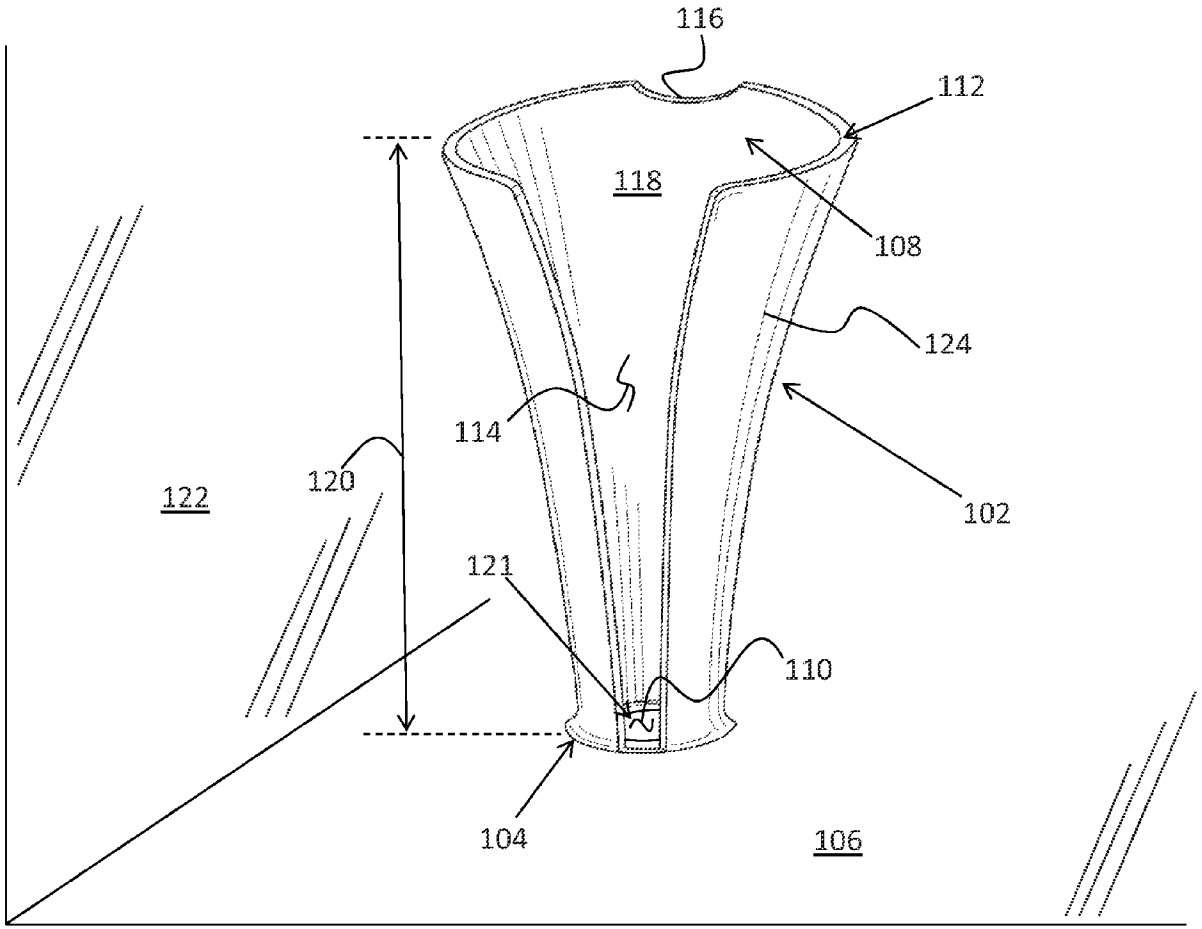
FIG. 1 is a perspective downward-looking view of a hair sink with a body that defines a water channel extending from the ground surface of a building to an upper portion of the body where a head/neck receiving area is formed in accordance with present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel hair washing sink with an elongated body to facilitate the easy and sanitary cleaning of long hair. Instead of being attached to and extending from the wall, as are traditional sinks, in accordance with one embodiment, the presently-inventive sink is freestanding. Due to the elongated bowl and lack of dependence on a wall for physical support, an operator of the sink advantageously now has the ability to maneuver around all sides of the sink and access the fully-extended hair of the person whose hair is being washed. The invention further provides the operator the ability to quickly and efficiently clean from the drain any residue generated from washing a person's hair. In addition, because the sink does not necessarily need to be supported by a side wall of the building, the present invention provides the operator with more locations to place the sink.

Referring now to FIG. 1, one embodiment of the present invention is shown in a perspective downward-looking view. FIG. 1 shows several advantageous features of the present invention, but, as will be described below, the invention can be provided in several shapes, sizes, combinations of features and components, and varying numbers and functions of the components. The first example of the hair washing sink 100 illustrates the sink 100 having a body 102. Specifically, the body 102 has a lower portion 104 that is coupled to a ground surface 106, i.e., the floor, of a building. The term "building" may be any structure intended for supporting or sheltering any use or continuing occupancy and includes structures such as salon, barber shop, or the home of an individual. The ground surface may be any surface utilized by the building for its occupants to travel across, but can also be an area built up or lower than the actual walking surface of the building.

The lower portion 104 of the body 102 is formed at least partially around a drain 110 and the body 102 extends upwardly from the drain 110 to an upper portion 112. The body 102 can also be seen defining an opening 114 that extends upwardly from the lower portion 104 of the body 102 toward the upper portion 112 of the body 102, thereby exposing the drain 110 as well as substantially an entire interior 108 of the body 102. A receiving area 116 is also shown located at the upper portion 112 of the body 102.

The shape of the body 102 defines a water channel 118 that extends from the upper portion 112 to the ground surface 106, which may or may not include the drain 110. As the sink 100 is generally suited for those users with long hair, the water channel 118 is an opening that contains the hair when placed therein and advantageously allows the operator to fully extend the user's hair along the path of the channel 118. In one embodiment, "long hair" can be defined as hair having a length such that when fully extended, the hair would come into contact with a bottom of a standard hair salon sink bowl and cover the drain hole. The elongated water channel 118 obviates the problem with prior-art sinks, where longer hair is bunched at the base of the sink, sits in dirty water, and covers the drain hole. The presently-inventive sink allows the operator to thoroughly rinse and clean the hair in its elongated state and further allows the hair to dry faster (i.e., excess water can be squeezed out of it) than it would, had it been bunched up together or collecting at the drain area of the prior-art sinks. Although the sink 100 is suited for longer hair, those persons skilled in the art will still appreciate how the novel features of the present invention apply to those users with shorter hair and the operators of the sink 100.

In one embodiment of the present invention, the body 102 extends to a height 120 ranging approximately from 1.5 feet to approximately 3.5 feet. In other embodiments, it is, more specifically, the receiving area 116 which extends the total maximum height 120. Further, the assembly may vary to a maximum height, indicated by reference number 120 in FIG. 1, dependent on the location of the head/neck area of a person, also referred to herein as a user. With the sink body 102 extending a sufficient height 120 from the ground surface 106, the hair of the user generally never touches or reaches a lower portion 121 of the water channel 118 where the drain 110 is located, such that clean, washed, hair remains uncontaminated.

In one embodiment, the lower portion 104 of the body 102 is attached to the ground surface 106 with bolts, screws, or other attachment mechanisms. In other embodiments, the lower portion 104 is coupled to the floor surface 106 using the concrete in the foundation of the building, by the weight of the body 102, or by other coupling mechanisms. In the embodiment shown in the drawing figures, the body 102 is supported by the ground 106 and does not rely on a side wall 122 of the building for physical support. As the sink 100 relies generally only on the ground surface 106 for physical support, this uniquely gives the sink 100 the ability to be placed in various locations within the building and not just on the side wall 122. The various installation location choices advantageously give the operator placement options not generally available with prior-art sinks. Of course, the water supply will be run through the floor to the inventive sink. The placement options of the sink also allow the user to access and clean the hair, and the drain, from behind the sink body 102. In other embodiments, the body 102 may have portions that that are supported by the wall 122, but the opening 114 would still generally be unobstructed by the side wall 122 and advantageously continue to provide the operator with access to the lower portion 121.

When the person's hair is placed within the water channel 118 the operator carries out the rinsing and washing process. In one embodiment, the body 102 is formed at least partially around the drain 110, such that the runoff of water and other residue from the cleaning process is removed. In other embodiments, the drain 110 is completely surrounded by the body 102, as shown in FIG. 1. The side wall 124 of the body 102, also referred to herein as a "discontinuous" side wall, may completely surround the drain 110. The term "discontinuous side wall" is defined herein as a wall that has at least one gap along the circumference of the wall. In other embodiments, the body 102, or discontinuous side wall 124, is partially, as opposed to completely, overlapping the drain 110 such that water is removed, but at a reduced volumetric flow rate. In further embodiments, the body 102, which again also includes the discontinuous side wall 124, may not overlap the drain 110, rather it has an opening around the lower portion 104 that delivers any accumulated water to the drain 110 located within the relative proximity. In all embodiments, however, the drain 110 can be said to be placed in fluid communication with the water channel 118. The discontinuous side wall 124 is formed to allow the water to flow to the drain 110, but also reduces water or other residue generated from the cleaning process from exiting into the external environment surrounding the side wall 124.

The opening 114 is illustrated as extending upwardly from the lower portion 104 toward the upper portion 112, such that it exposes the drain 110. An operator may now, advantageously, clean or access the drain 110 area of the sink 100 to clean any residue or dislodged hair follicles with traditional cleaning tools, such as a broom or mop. This is beneficial as it does not require the operator to remove any debris manually with his or her hands or any towels.

Figure 2:
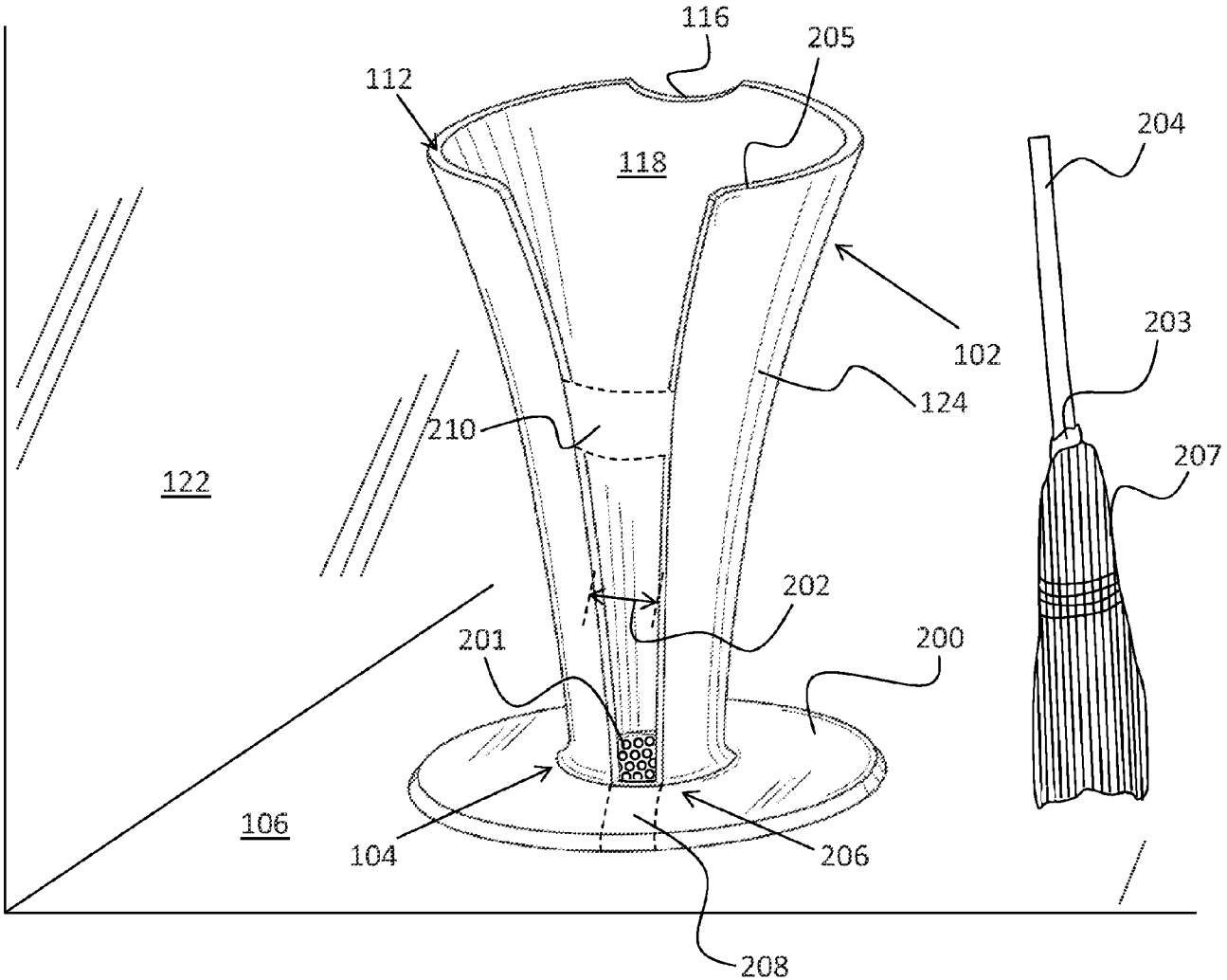
FIG. 2 is a perspective downward-looking view of the hair sink of FIG. 1 having a base and a discontinuous gap extending upward toward the upper portion with the gap being sized to allow a standard-sized broom to pass through in accordance with one embodiment of the present invention.

Now referring to FIG. 2, one embodiment of the present invention is shown. As shown, the drain 110 also includes a drain screen 201 coupled thereto. A drain screen 201 is generally known to those skilled in the art to catch larger objects than the formed apertures located on the surface of the drain screen 201, such as residue and dislodged hair follicles. In other embodiments, the drain 110 may not necessarily contain a drain screen 201 or may have an adjustable drain plug that would allow water to enter, but exclude larger objects. To facilitate the operator in accessing and cleaning the lower portion 104, the opening 114 has, and the side wall 124 defines, a discontinuous gap 202. The term "discontinuous gap" is defined as a generally horizontal opening that has a starting point and ending point which both define an interval on a referencing structure, surface, or other object. In one embodiment, the discontinuous gap 202 is substantially unobstructed by the side wall 122 of the building to allow the operator to effectively rinse a person's hair and also to clean the inside portion 121. In other embodiments, the opening 114 is also substantially unobstructed by the side wall 124 or a chair that the person, who's having their hair washed, is sitting in. As described, both the opening 114 and/or the discontinuous gap 202 will be unobstructed sufficiently enough for the operator to access the lower portion 121 of the water channel 118. In accord with one embodiment, the discontinuous gap 202 extends from the ground surface 106 to the upper portion 112, or the height 120 of the body 102. In other embodiments, the discontinuous gap 202 extends less than or greater than the body height 120.

Figure 4:
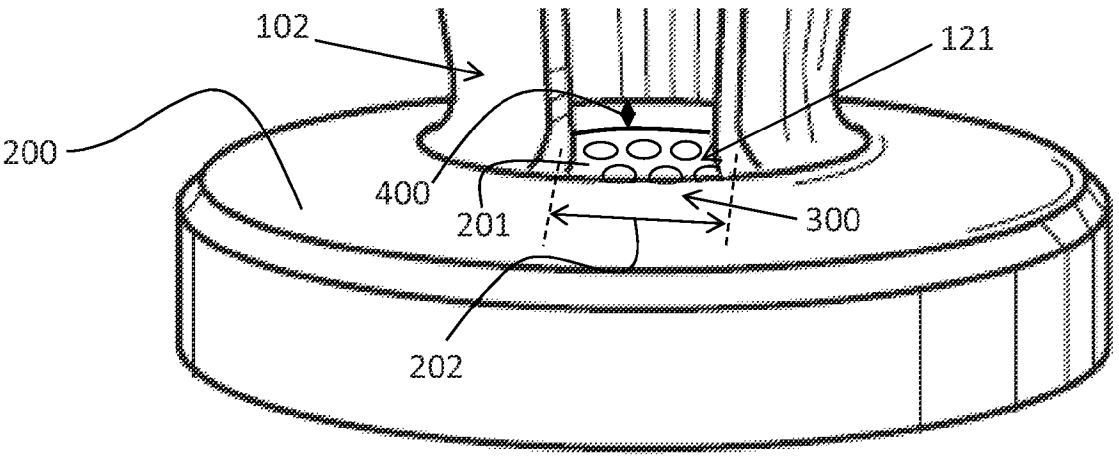
FIG. 4 is a fragmentary perspective downward-looking view of the base shown in FIG. 2 with a drain screen that is non-co-planar with a portion of the base in accordance with an embodiment of the present invention.

Also shown in FIG. 2 is the sink 100 having a base 200 that is coupled to the lower portion 104 of the body 102. As described above, the body 102/side wall 124 is directly supported by only the ground surface 106. In other embodiments, the base 200 extends outwardly from the lower portion 104 of the body 102 and provides physical support to the sink 100. As shown in FIG. 2, the base 200 extends from, and is directly coupled to, the lower portion 104 of the body 102. The base 200, however, may also be coupled above the lower portion 104 of the body 102 such that the lower portion 104 can be inserted into a drain 110. The base 200 may also at least partially surround the drain 110, such that the lower portion 104 is coupled onto the top of the base 200 and water passes from the base 200 to the drain 110, as shown in FIG. 4. The base 200 may be utilized in certain instances such as when the sink 100 is coupled to the ground 106 with only its weight or when permanent coupling mechanisms are not used or available. In one embodiment, the base 200 and the entire body 102/side wall 124 are made out of a ceramic material. In other embodiments, the above are made with a metallic material, composites, resilient polymers, or other similar materials that are generally resistant to water exposure and capable of supporting the weight of the head/neck area of the user. The base 200 may also be formed with any portion of the body 102 during the manufacturing process through injection molding or casting, depending on the material utilized for the body 102 and the base 200. In other embodiments, the base 200 may also be coupled to the side wall 124 of the body 102 with adhesives, screws, or similar coupling mechanisms.

In one embodiment, shown in FIG. 2, the discontinuous gap 202 extends from the ground surface 106 to the upper portion 112 of the body 102. In other embodiments, the discontinuous gap 202 extends to an upper edge 205 of the body 102. In such a configuration, the operator is provided with optimum access to the drain 110 and/or the drain screen 201 such that the operator can clean and remove any debris the draining area. Moreover, the operator can efficiently access, rinse, and/or wash the longer hair of a person when the hair is fully extended within the water channel 118, which was not available in most known prior-art hair washing sinks.

In further embodiments, the discontinuous gap 202 is further sized to allow a cleaning tool 203, such as a standard-sized broom (shown in FIG. 2), to at least partially enter the gap. As such, the operator has the ability to easily access to the lower portion 121 of the water channel 118 to remove debris, such as dislodged hair for example. Generally, a standard-sized broom 203 has a cleaning portion 207, typically having fibers, bristles, wire, or other filaments designed for cleaning, and a handling portion 204, or a handle, that is typically parallel to those fibers. Although the present invention references a standard-sized broom 203 as being able to insert the opening 114, those skilled in the art can still appreciate that any cleaning tool, such as a smaller hand tool, may also be able to have access to the lower portion 121 of the water channel 118.

In one embodiment, the discontinuous gap 202 would be sufficiently sized such that some, or all, of the cleaning portion 207 of the broom 203 or any other cleaning tool is able to fit through the discontinuous gap 202 in order have access to the lower portion 121 of the water channel 118. This provides the operator quick and efficient access to clean and remove debris from the drain 110 and/or drain screen 201. In other embodiments, the cleaning portion 207 of the broom 203 enters at the upper portion 112 of the body 102 and is able to access the drain 110 or drain screen 201 and force any debris through the discontinuous gap 202 or up and out through the upper portion 112 of the body 102. In one embodiment, the drain screen 201 pulls up and out, for example, by pulling a cord or handle, for cleaning.

In other embodiments, the discontinuous gap 202 has one or more portions 210 that prevent it from extending continually to the upper edge 205. As such, the body 102 completely surrounds the water channel 118 at those portions 210 along the height 120 of the body 102. As exemplified by the section 210 in FIG. 2, the operator will still, advantageously, have access through the discontinuous gap 202 to clean or remove any debris at the drain 110 or drain screen. Although the discontinuous gap 202 is shown in FIG. 2 as extending from a top portion 206 of the base 200, other embodiments may include the discontinuous gap 202 extending to the ground surface 106 or where the drain 110 and/or drain screen 201 is located. If the discontinuous gap 202 extends to the ground 106, then a section 208 (indicated with dashed lines) of the base 200 may be removed to facilitate the removable of any debris.

In one embodiment, the discontinuous gap 202 increases in width as the body increases in height 120. In other embodiments, the discontinuous gap 202 width may be a constant width, e.g., 6 inches, which extends upwardly from the drain 110 to a gap height that equals the body height 120. In other embodiments, the length of the discontinuous gap 202 may be less than a total height 120 of the body 102. In such embodiments, however, the width and height of the discontinuous gap 202 are typically sized sufficiently to allow access to the lower portion 121 of the water channel 118, while simultaneously preventing a substantial amount of the water, used in the rinsing/washing process, from escaping outside the side wall 124.

Figure 3:
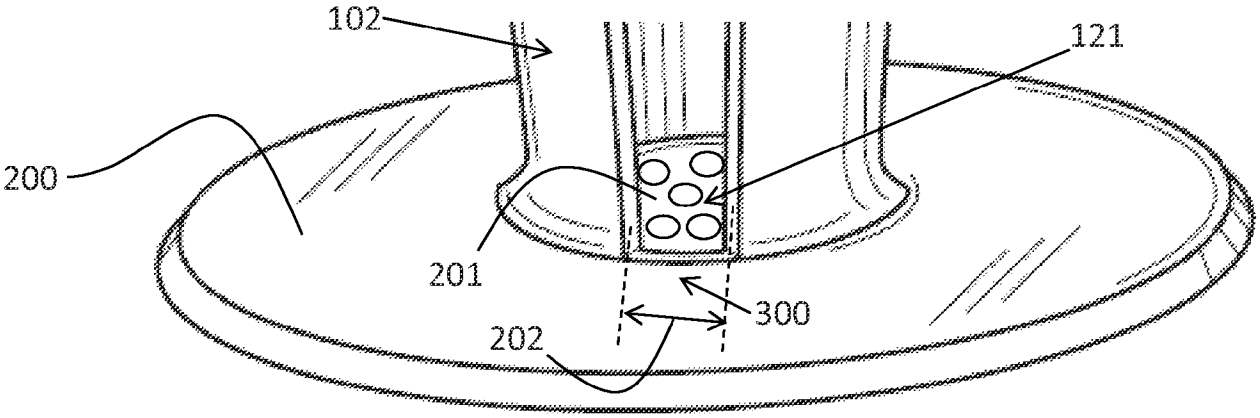
FIG. 3 is a fragmentary perspective downward-looking view of the base shown in FIG. 2 with a drain screen that is co-planar with a portion of the base in accordance with an embodiment of the present invention.

Referring now to FIGS. 3 and 4, two different embodiments of the base 200 are shown from downward-looking perspective views. In one embodiment, as shown in FIG. 3, the base 200 has a portion 300 adjacent to the discontinuous gap 202 and is substantially co-planar with the lower portion 121 of the water channel 118. Now, an operator may easily clean and remove any debris around the drain 110 or drain screen 201 with a cleaning tool 203. As such, the operator advantageously does not have to remove any of the debris with his or her hands and/or with any towels and may simply use traditional cleaning tools, such as a broom.

In other embodiments, the portion 300 of the base 200, as shown in FIG. 4, is non-co-planar with the lower portion 121, such that the operator will be required to lift any accumulated or collected debris from the washing process over an elevated surface 400. This embodiment, by placing a height barrier in the drain area, helps prevent water from splashing out of the drain area during the hair-washing process.

Figure 5:
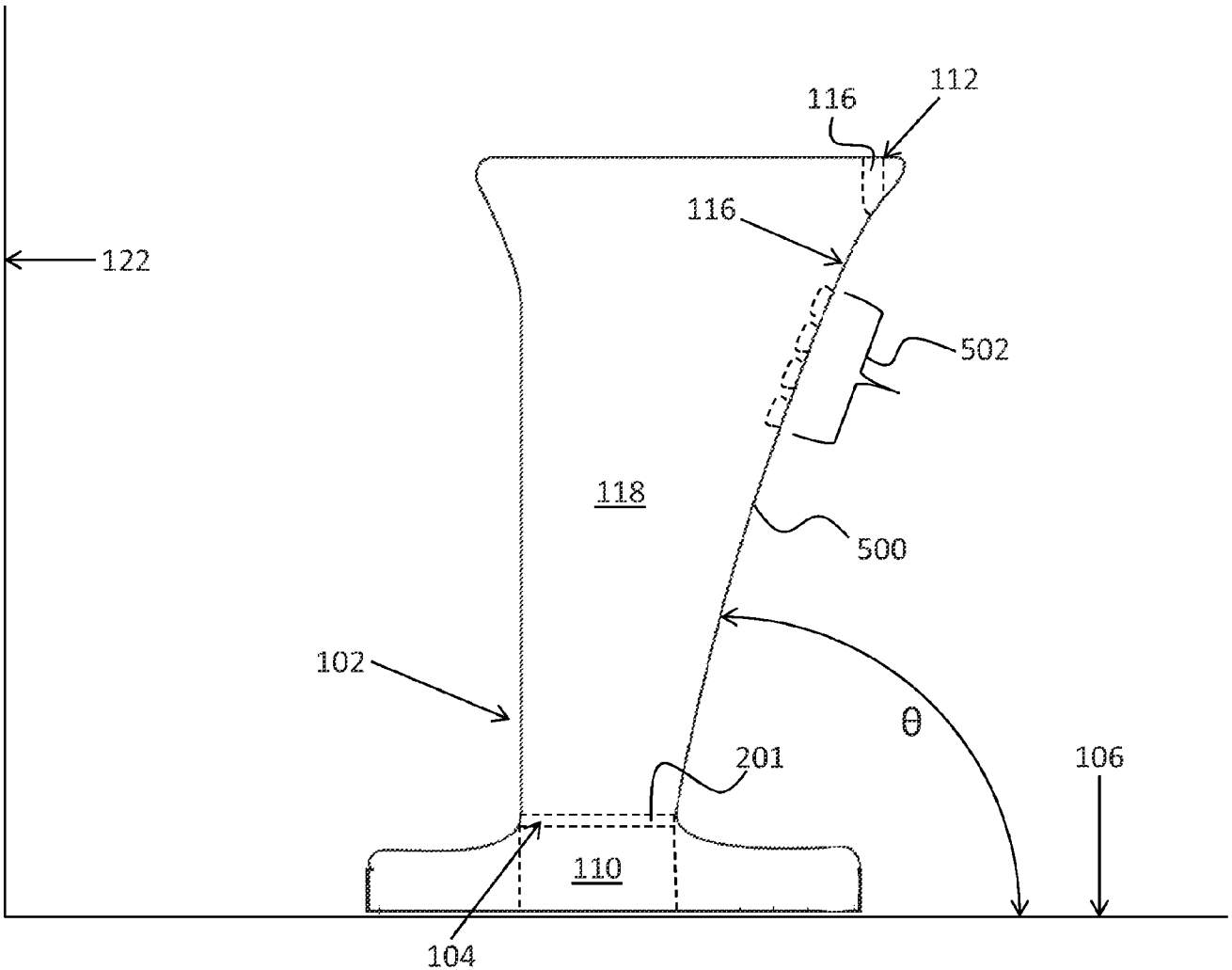
FIG. 5 is an elevational cross-sectional side view of the sink of FIG. 1 with an interior surface having at least one non-perpendicular angle with respect to the ground surface in accordance with an embodiment of the present invention.

FIG. 5 illustrates one embodiment of the present invention from a side cross-sectional elevational view. The body 102 of the sink 100 can be seen having a front interior surface 500 below the receiving area 116 that has at least a portion at a non-perpendicular angle, "theta," with reference to the ground surface 106. The angle may be acute at certain surfaces, perpendicular at others, and even obtuse in particular embodiments. As illustrated in FIG. 5, the interior surface 500 extends at an acute angle from the lower portion 104 to the upper portion 112 and is concave in nature, when viewed from the water channel 118. The body 102 allows the hair of a person to be supported by the surface 500 when the hair is extended, as opposed to being wet and freely hanging, which reduces the tensile forces felt by that person. This beneficially provides the added comfort to the person who is getting their hair washed, while still preventing the hair from becoming contaminated with any residue from the cleaning process. Furthermore, the interior surface 500 may also include ridges 502 or extrusions on which the operator can rub the subject's hair to produce a superior lather and overall better cleaning process. In other embodiments, the interior surface 500 is angled acutely just below the upper portion 112, such that the hair is supported by the surface 300, and has a portion that is angled obtusely just above the lower portion 104, such that the hair is then freely hanging. Moreover, the interior surface 500 may be perpendicular to the ground surface 106 such that the hair is freely hanging when the user's head/neck is in the receiving area 116. It should be understood to those skilled in the art that the body 102, including the discontinuous side wall 124, may be formed in various shapes and with various curves without interfering with the spirit and scope of the present invention.

In one embodiment, the receiving area 116 is formed the general shape of a half circle such that it substantially contours a head/neck area of the user. The receiving area 116 may also have a polymer, foam, or other similar material that is coupled to the receiving area 116. This provides superior comfort and support to the user's head/neck area when placed in the receiving area 116. In other embodiments, the receiving area 116 is formed in alternative shapes or may be a designated portion of the upper edge that has no shape. In order to effectively allow runoff from the hair rinsing and cleaning process, the receiving area 116 is opposite to the base 200 or drain 110. In other embodiments, the receiving area 116 may be located above or below the upper edge of the body 102. As such, the user's hair is not required to be pulled through an open aperture, such as those built into the prior-art tunnel-like apparatuses, nor is the hair required to rest and collect at the drain area of the sink bowl.

Figure 6:
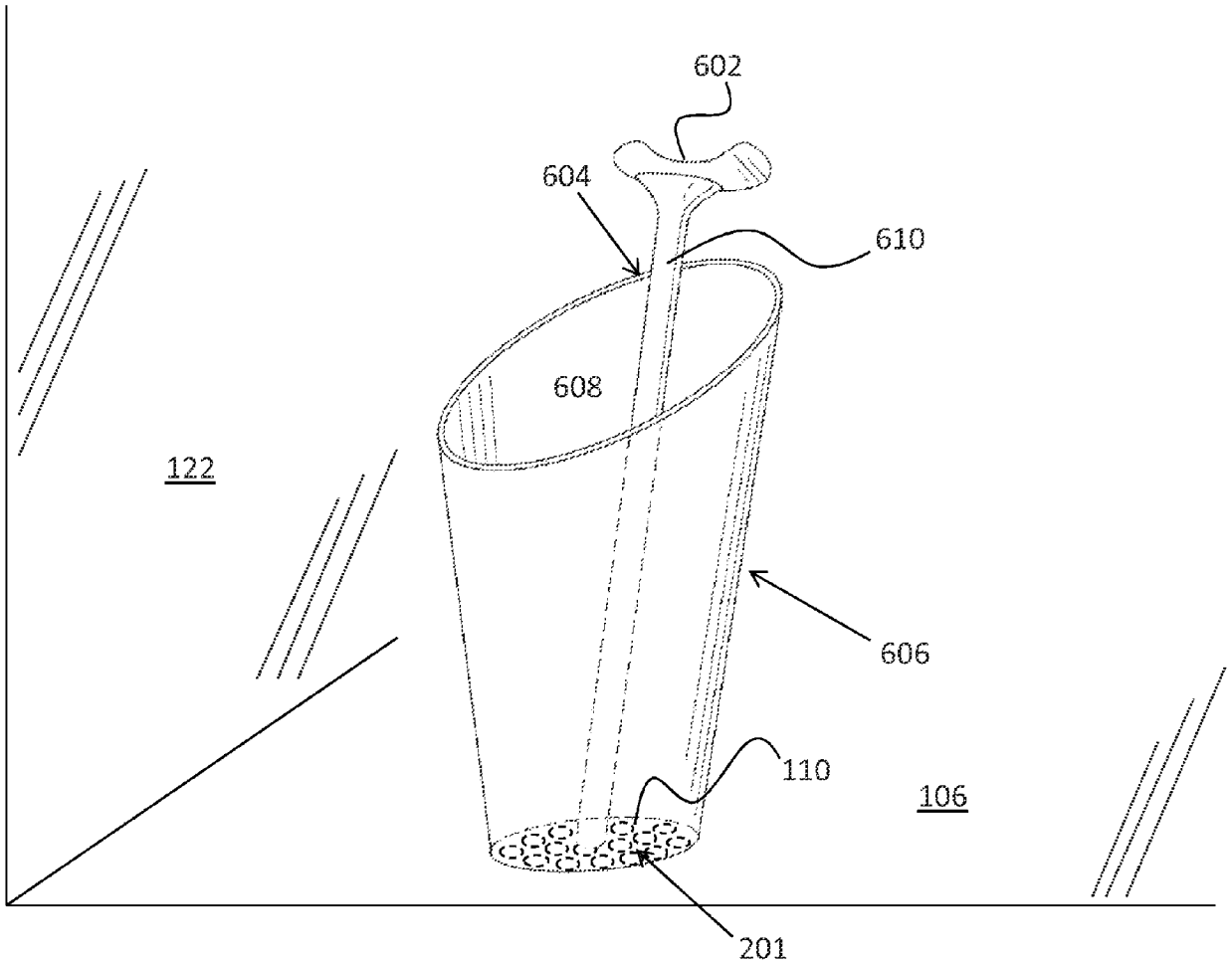
FIG. 6 is a perspective downward-looking view of a hair-washing sink with a receiving area extending above an upper portion of its body in accordance with an exemplary embodiment of the present invention.

Now referring to FIG. 6, an embodiment of a sink 600, in accordance with the present invention, has a receiving area 602 extending upwardly past the upper portion 604 of the body 606. As such, the person would place his or her head/neck in the receiving area 602 allowing the hair to drape and fall into a water channel 608. This feature also advantageously allows the operator to accommodate those users with hair. As an additional feature, the receiving area 602 may also have an extendable and retractable head/neck support assembly 610 in order to comfortably adjust the user's head/neck area at an appropriate height. As such, the chair that supports the user would not have to adjust to certain positions that are difficult, if not impossible, based upon the structural limitations of the chair and/or the person whose hair is being washed. In one embodiment, the head/neck support assembly 610 is incorporated into the body 606 or extends from a portion of the ground surface 106, drain 110, or drain screen 201 that does not substantially prohibit the draining of water produced from the washing process. In other embodiments, the head/neck support assembly 610 is not adjustable. Further, in additional embodiments, the head/neck support assembly 610 extends above the upper portion 604 of the body 606 or is part of the upper portion 604/upper edge of the body 606.

Figure 7:
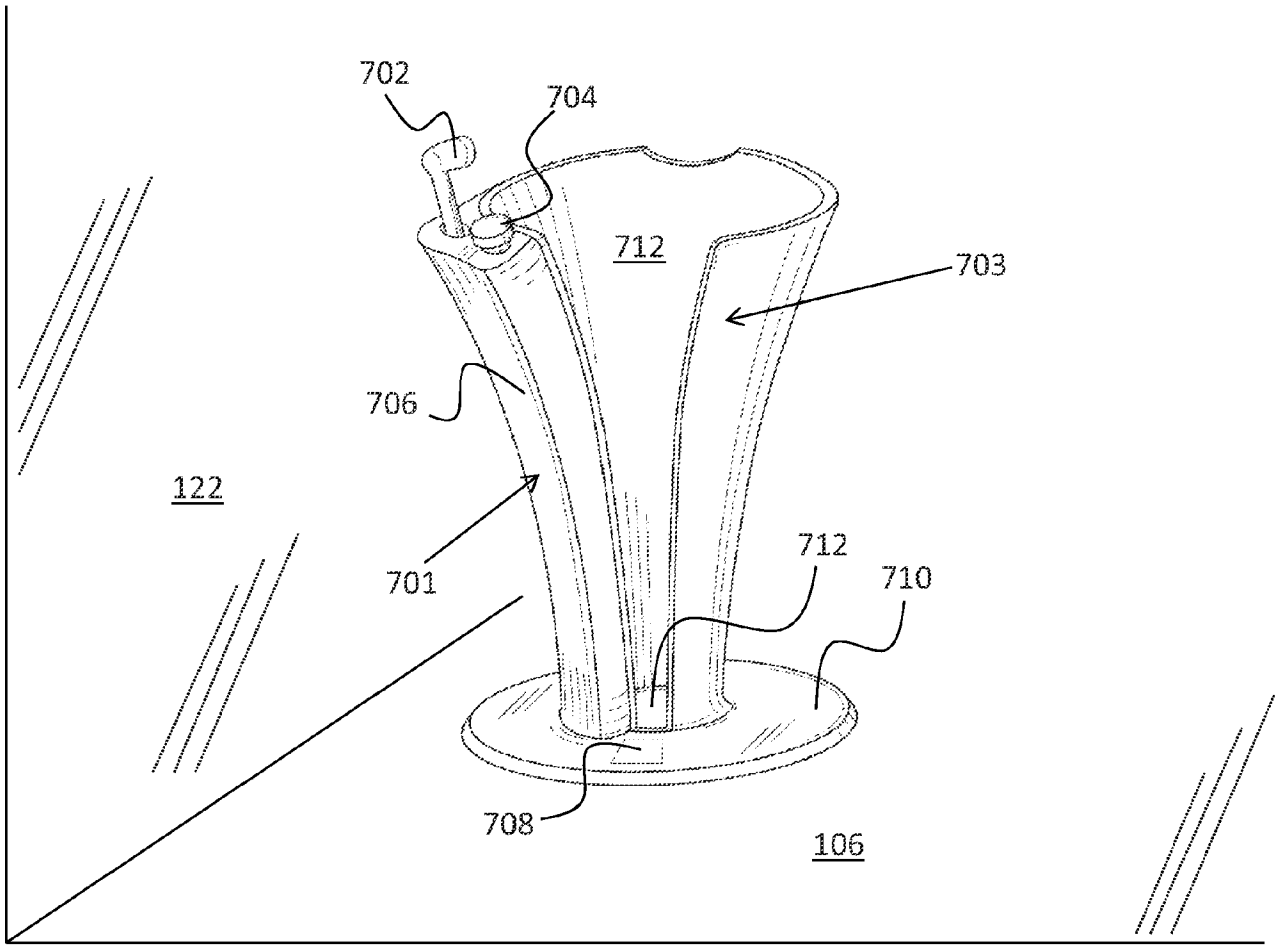
FIG. 7 is a perspective downward-looking view of a hair-washing sink with an integrated water facet assembly in accordance with the present invention.

FIG. 7 provides a perspective downward-looking view of a sink assembly 700 that includes a water faucet assembly 701 coupled to the body 703. As the sink 700 may be freestanding and in close proximity to a wall, the water assembly 701 provides water to the operator. The water assembly 701 generally includes at least a faucet 702, a hose or pipe structure (not shown) delivering water from a water source (not shown), and a valve 704. The faucet 702, hose, and valve 704 should also be within relative proximity to body 703 of the sink 700 such that there are no hoses or pipes revealed or exposed on the ground surface 106. The water assembly 701 may integral with the body 703 or coupled to the body and hidden with a cover 706 that creates a generally more aesthetically pleasing appearance.

The hose or pipe delivering water to the faucet 702 may run through the base 710, the body 703, or the ground 106 and extends upwardly toward the faucet 702, which is generally located around the upper portion of the body 703. In other embodiments, the hose or the faucet 702 may be located at, or coupled to, different locations along the body 703 and may be extendable and retractable. When the hose is retractable, the operator can maneuver the faucet 702 in various locations to effectively and efficiently clean and wash the user's hair while extended in the water channel 712. In other embodiments, the body 703 may not have the water assembly 701 attached thereto, such that the operator will use water generated from another sink having a faucet or other water source within the building. The base 710 may also have an access panel 708 located on it such that an operator can check the drain 712 area or access the hose for the water assembly 701. In other embodiments, the sink 700 may not have the access panel 708 or the panel 708 may be located on other areas of the body 703.

Figure 8:
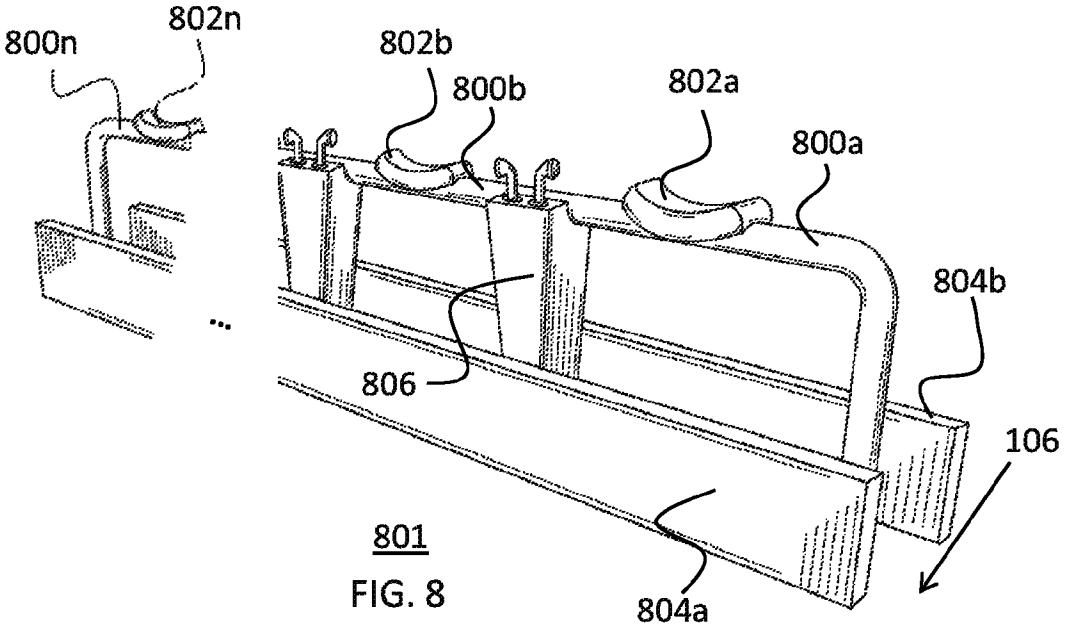
FIG. 8 is a perspective downward-looking view of a hair washing station with a plurality of structures that extend upwardly away from the floor surface and a plurality of receiving areas above a water collection area in accordance with the present invention.
Figure 9:
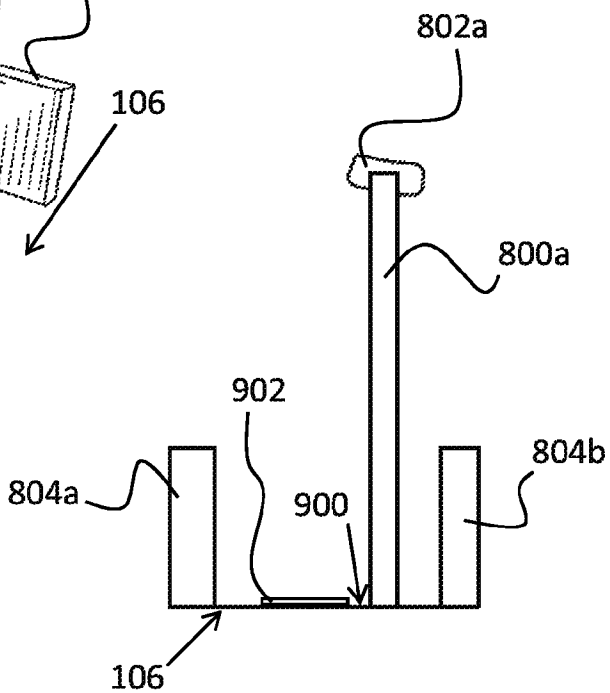
FIG. 9 is an elevational side view of the hair washing station of FIG. 8.

Referring now to both FIGS. 8 and 9, another embodiment of the present invention includes a hair washing assembly that has a plurality stations 800*a-n* and a plurality of receiving areas 802*a-n*, where "n" represents any number between zero and infinity. The novel hair washing assembly 801 provides the ability to accommodate washing of longer hair. The plurality of stations 800*a-n* extend from the ground surface 106 of the building, each station having a corresponding receiving area 802*a-n*. As shown in FIG. 9, the plurality of stations 800*a-n* at least partially interpose a water collection area 900 that includes at least one drain 902. In other embodiments, the at least one drain 902 may include a plurality of drains along with corresponding drain screens and/or drain plugs. In further embodiments, the water collection area 900 may be defined by one or more water barriers 804*a-b*. Further, the water collection area 900 may have surfaces that are angled toward the at least one drain 902 such that any water or debris from the cleaning process is removed.

Further, one embodiment provides that each or at least two of the stations 800*a-n* include one or more water assemblies 806, such as water assembly 701, which was described above. As such, the user would be supported in a chair that is titled backward such that the head/neck area of the user would be supported by one of the plurality of receiving areas 802*a-n*. The operator(s) may then clean and wash numerous users' hair at once. This hair washing station would also allow the operator to clean the water collection area 900, including multiple drain areas, from any residue produced from the cleaning process, at one time.

A hair washing sink has been disclosed that facilitating easy and sanitary cleaning of a long hair with significant benefits over the presently available hair-washing sinks. A person with long hair can completely extend their hair within the sink body without the hair accumulating by the drain area of the sink or coming in contact with dirty water. The body also defines an opening that exposes the drain, which allows an operator to clean any accrued dirt or debris from the drain or drain screen by using traditional cleaning tools. This sink also advantageously provides the operator with quick and efficient access to the hair while placed in the water channel.

What is claimed is:

1. A hair washing sink comprising:

a body coupled to a ground surface of a building, the body having:

a discontinuous side wall, the discontinuous side wall:

extending upwardly from the ground surface toward an upper edge of the body;

defining a water channel with a lower portion substantially at the ground surface and sized to accommodate and provide access to long hair during a hair-washing process; and defining an opening extending upwardly from the ground surface toward the upper edge, the opening sufficiently sized to allow a cleaning portion of a standard-sized floor broom to enter the lower portion of the water channel;

a drain in fluid communication with the water channel; and a head/neck support shaped to substantially contour a head/neck area of a user.

2. The sink according to claim 1, wherein:

the body is supported by the ground surface only and does not rely on a wall for physical support.

3. The sink according to claim 1, wherein the body further comprises:

a front interior surface below the receiving area, the front interior surface having at least a portion at a non-perpendicular angle to the ground surface.

4. The sink according to claim 1, wherein:

the body is formed at least partially around a drain.

5. The sink according to claim 1, wherein:

the head/neck support is in the shape of a half circle.

6. The sink according to claim 1, wherein:

the body extends upwardly from the ground surface a height greater than 1.5 feet.

7. The sink according to claim 1, wherein:

the opening extends from the lower portion to an upper edge of the body.

8. The sink according to claim 1, wherein:

the opening extends from the ground surface to the upper portion.

9. The sink according to claim 1, wherein:

the opening in the body is sized to allow a bristle portion of a standard-sized broom to pass through.

* * * * *